United States Patent [19]

McVey

[11] 4,065,691

[45] Dec. 27, 1977

[54] CERAMIC LAMP HAVING ELECTRODES SUPPORTED BY CRIMPED TUBULAR INLEAD

[75] Inventor: Charles I. McVey, Shaker Heights, Ohio

[73] Assignee: General Electric Company, Schenectady, N.Y.

[21] Appl. No.: 747,552

[22] Filed: Dec. 6, 1976

[51] Int. Cl.[2] ..... H01J 61/22; H01J 61/28; H01J 61/30; H01J 61/36

[52] U.S. Cl. ..... 313/174; 313/217; 313/220; 313/229

[58] Field of Search ..... 313/174, 220, 217, 229

[56] References Cited

U.S. PATENT DOCUMENTS

| | | | |
|---|---|---|---|
| 3,825,788 | 7/1974 | Pfaue et al. | 313/174 |
| 3,886,392 | 5/1975 | Barakitis et al. | 313/220 |
| 3,906,273 | 9/1975 | Kozlowski | 313/220 |
| 3,911,313 | 10/1975 | Makar, Jr. | 313/217 X |
| 3,974,410 | 8/1976 | Collins et al. | 313/229 X |

*Primary Examiner*—Palmer C. Demeo

*Attorney, Agent, or Firm*—Ernest W. Legree; Lawrence R. Kempton; Frank L. Neuhauser

[57] ABSTRACT

A high pressure alkali metal vapor lamp envelope of alumina ceramic has an end closure which includes an externally projecting thin-walled metal tube serving as in inlead and as a reservoir for excess alkali metal. An electrode is mounted on a tungsten shank which projects into the metal tube and is locked in place by crimping the tube about it externally of the envelope. The crimping leaves restricted channels which allow passage of the alkali in vapor form but prevent its movement as a liquid.

8 Claims, 3 Drawing Figures

Fig. 1
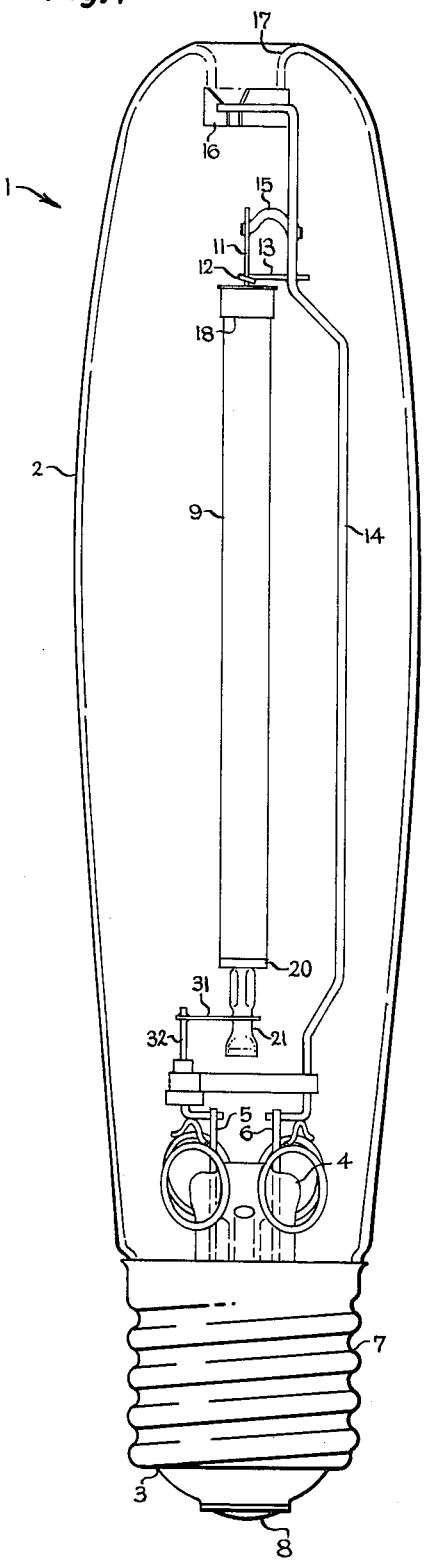
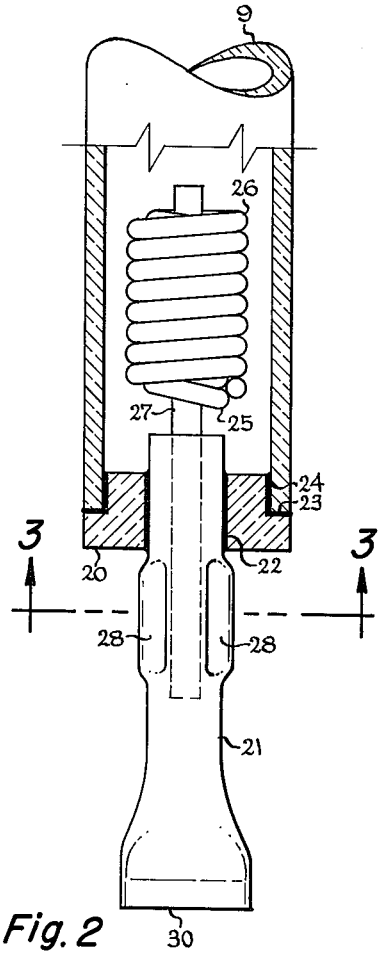
Fig. 2
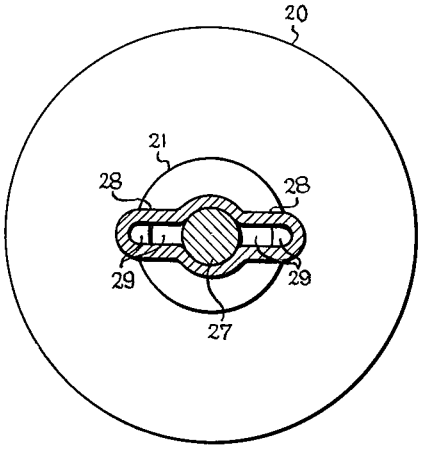
Fig. 3

CERAMIC LAMP HAVING ELECTRODES SUPPORTED BY CRIMPED TUBULAR INLEAD

The invention relates generally to arc discharge lamps utilizing alumina ceramic envelopes, and more particularly to the end closure and inlead seal structure.

BACKGROUND OF THE INVENTION

The invention is most useful with high intensity sodium vapor lamps of the kind comprising a slender tubular ceramic arc tube which is generally mounted in an outer vitreous envelope or glass jacket. The ceramic envelope is made of a light-transmissive refractory oxide material resistant to sodium at high temperatures, suitably high density polycrystalline alumina or synthetic sapphire. The filling comprises sodium and usually includes mercury for improved efficiency, along with a rare gas to facilitate starting. The ends of the alumina tube are sealed by closure members affording connection to thermionic electrodes which may comprise a tungsten coil structure activated by electron emissive material. The outer envelope which encloses the ceramic arc tube is generally provided at one end with the usual base. The electrodes of the arc tube are connected to the terminals of the base, that is to shell and center contact, and the interenvelope space is usually evacuated in order to conserve heat.

The high pressure sodium vapor lamps which first appeared commercially in 1966 utilized end caps of niobium having niobium tubes extending through them into the ceramic arc tube. One niobioum tube which was used as an exhaust tube had an opening into the interior of the ceramic envelope, and was hermetically tipped and sealed off after the envelope had received its filling. The other niobium tube, sometimes known as the dummy exhaust tube, had no such opening and served merely as an inlead and electrode support. Niobium was used because it is a reasonably close match to alumina ceramic in coefficient of expansion, but it is a relatively expensive metal.

In my U.S. Pat. No. 3,882,346, Ceramic Arc Tube Mounting Structure, I describe an end seal which may be used to replace the end cap and dummy exhaust tube of niobium. It utilizes a ceramic plug sealed in the end of the arc tube and having a central perforation through which is sealed a lead wire of ceramic matching metal, suitably niobium for an alumina ceramic plug. This construction reduces the quantity of niobium used in the dummy seal about to the irreducible minimum. One object of the invention is to reduce in similar fashion the quantity of niobium used in the exhaust seal.

In lamps having a projecting exhaust tube, the sealed-off exhaust tube provides a reservoir for excess sodium mercury amalgam external to the arc tube proper. This places the excess amalgam in a location removed from the direct heat of the arc and of the electrode, and arc tube blackening as the lamp ages has a minimal effect on sodium vapor pressure and on lamp voltage. Also the use of an external reservoir facilitates close adjustment of the heat balance in the lamp, as by grit blasting a portion of the exterior of the niobium tube in order to regulate the heat loss therefrom to achieve optimum temperature for lumen output and long life. However the external reservoir construction has had the drawback that the exhaust tube must be located lowermost. This has necessitated two versions of a given lamp, a base up and a base down design, the arc tube being inverted relative to the jacket in one as against the other. If either version is used in the incorrect orientation, vibration or mechanical shock may cause a droplet of amalgam to drop out of the exhaust tube into the hotter arc tube. The resulting sudden rise in vapor pressure and the corresponding increase in lamp voltage may be severe enough to extinguish the lamp. In extreme cases, the relatively cool amalgam droplet has been known to cause thermal cracking of the arc tube when it strikes. Another object of the invention is to provide an end seal construction for the exhaust tube end of the ceramic arc tube which reduces the quantity of expensive niobium required, and yet allows the lamp to be burned in any orientation without the disadvantages or limitations previously described.

SUMMARY OF THE INVENTION

In accordance with my invention, the ceramic arc tube or envelope of a high pressure alkali metal vapor lamp has an end closure which includes an externally projecting thin-walled metal tube serving as an inlead and as a reservoir for excess alkali metal. The electrode at the same end of the arc tube includes a tungsten shank which projects into the metal tube and is locked in place by deforming the metal tube about it at a place external to the ceramic envelope.

In a preferred embodiment the end closure comprises an alumina ceramic plug through which projects a thin-walled niobium tube. The tungsten electrode shank projects into the niobium tube and is locked in place by crimping the tube about it. The crimping leaves restricted channels which allow passage of the alkali in vapor form but prevent its movement as a liquid whereby the lamp may be burned in any orientation.

DESCRIPTION OF THE DRAWING

In the drawing:

FIG. 1 shows a high pressure sodium vapor lamp embodying the invention and suitable for universal burning.

FIG. 2 is an enlarged detail of the end closure and crimped tubular inlead.

FIG. 3 is a cross section through the crimped inlead looking in the direction of the arrows 3, 3 and to a scale double that of FIG. 2.

DETAILED DESCRIPTION

A high pressure sodium vapor lamp 1 embodying the invention in preferred form and corresponding to a 400 watt size is illustrated in FIG. 1. It comprises a vitreous outer envelope 2 with a standard mogul screw base 3 attached to one end and comprising a reentrant stem press 4 through which extend, in conventional fashion, a pair of relatively heavy lead-in conductors 5, 6 whose outer ends are connected to the screw shell 7 and eyelet 8 of the base. The inner envelope or arc tube 9 centrally located within the outer envelope comprises a length of light-transmitting ceramic tubing, suitably polycrystalline alumina ceramic which is translucent, or single crystal alumina which is clear and transparent. The upper end of the arc tube is closed by an alumina ceramic plug through which extends a niobium inlead wire 11 hermetically sealed. The inlead supports the upper electrode which may be generally similar to the lower electrode illustrated in FIG. 2. A preferred upper end seal and electrode support structure is described and claimed in copending application Ser. No. 640,805, filed Dec. 15, 1975, by myself jointly with Robert L.

Kelling, entitled "Ceramic Envelope Plug and Lead Wire End Seal" and similarly assigned. The external portion of inlead 11 passes through a loop 12 in transverse support wire 13 attached to side rod 14. This arrangement allows for thermal expansion of the arc tube during operation when the lower end seal is rigidly fixed in place, and a resilient metal ribbon 15 assures a good electrical connection. Side rod 14 is welded to lead-in conductor 6 and has its upper end braced by spring clamp 16 which engages inverted nipple 17 in the dome end of the outer envelope. A metal reflector band 18 may be desirable around the upper end of the arc tube in order to maintain the desired temperature at the upper end seal, particularly in smaller sizes of lamps such as 250 watts or less.

The invention proper resides in the lower end closure and electrode support assembly. One preferred construction is illustrated in FIGS. 2 and 3. It comprises a shouldered alumina ceramic plug 20 having a central aperture through which extends a thin-walled niobium tube 21 which serves as an exhaust tube and as an inlead. The tube extends but a short distance through the plug and is hermetically sealed therethrough by sealing composition indicated by the thick line at 22. The plug in turn has its neck portion penetrating into ceramic envelope 9 whose end butts against the plug's shoulder portion. A hermetic seal is effected between the two parts by sealing composition indicated at 23 and 24.

The electrode proper comprises two layers of tungsten wire 25, 26 wound around the distal end of a tungsten shank 27 and located within the ceramic envelope. The shank extends far enough down into tube or inlead 21 that it can be securely locked in place by deforming the tube at a place outside the ceramic envelope in a manner pinching the shank over an appreciable length. Preferably the deformation is at an intermediate point in the tube which leaves a portion beyond it adequate to serve as a reservoir for excess amalgam. The illustrated crimp, sometimes known as a butterfly crimp, is of such a character, and it pinches the shank along the entire extent of the flattened portions or wings 28. At the same time restricted channels 29, best seen in FIG. 3, are left on both sides of the shank which communicate with the outer portion of the exhaust tube up to the tip 30. They allow passage of the sodium mercury amalgam in vapor form but prevent its movement as a liquid under ordinary operating conditions, even when the lamp is upended.

In the prior art sodium vapor lamps which utilized end caps of niobium having niobium tubes extending through them into the ceramic arc tube, the electrode had a short tungsten shank which was received in the crimped inner end of the niobium tube. Experience taught that mere crimping was not enough to support the relatively heavy tungsten electrode structure and this led to the practice of melting down the end of the niobium tube onto the tungsten shank by an electric arc drawn from a tungsten electrode in an inert gas atmosphere. This process, commonly referred to as TIG welding, was laborious and relatively expensive. Also it entailed heating the niobium to its melting temperature of 2450° C which in turn would cause some recrystallization of the tungsten shank. On small diameter shanks the degree of recrystallization and resulting embrittlement might be enough that the weight of the electrode under vibration would fracture it. These problems are avoided with my new structure inasmuch as no heating is required to fasten the tungsten shank into the niobium tube.

Another advantage which follows from the elimination of the need for heating or welding is that the electrode windings may be formed on the shank by back winding. In the prior art electrodes such as illustrated for instance in U.S. Pat. No. 3,708,710 — Smyser et al., the electrode coiling consisted of an inner coil wound tightly around the shank and an outer coil screwed over the inner coil. The manufacturing procedure comprised the sequence of winding the inner coil on the shank, crimping and TIG-welding the shank in the end of the niobium tube, dipping the shank and inner coil into a suspension of emission material, allowing the material to dry, and then screwing the outer coil over the inner coil. Inasmuch as hand labor was required throughout this entire sequence of operations, the product was relatively costly. With my improved structure, the two layers of the electrode coiling may be wound on the shank in a single operation, the inner layer 25 tightly on the shank and then the outer layer 26 over it by backwinding. In backwinding, one continues to rotate the shank in the same direction but the pitch or direction of progression of the turns is reversed so that the outer turns lock the inner turns. This entire operation may be done mechanically including dipping the backwound coils into the suspension of emission material. Thus with my invention the only manual operation remaining is that of inserting the shank of the coated electrode into the niobium tube in place for crimping.

In assembling the arc tube, the hermetic seals including that of the niobium tube through the ceramic plug and that of the plug to the arc tube may be made using various sealing compositions, sometimes referred to as sealing glass, which comprise primarily aluminum oxide and calcium oxide. One composition which we have used successfully is designated G-54 and consists of approximately 54.0% $Al_2O_3$, 38.5% CaO and 7.5% MgO by weight. Other compositions which may be used are described generally in U.S. Pat. No. 3,281,309 — Ross, and specifically in U.S. Pat. Nos. 3,441,421 — Sarver et al., and 3,588,577 — McVey. The empty arc tube may be dosed in a chamber which is exhausted of air and filled with the inert gas which will serve as starting gas in the finished article. Within this chamber the arc tube is supported with the exhaust tube uppermost and a feed device releases a ball of liquid sodium mercury amalgam into it. The amalgam has previously been heated to a temperature above room temperature where it is liquid and flows readily. A mechanical device then pinches shut the end of the exhaust tube as indicated at 30 with sufficient force to make a hermetic cold weld. The arc tube is supported in the outer envelope by a connector 31 which is welded across from tubular inlead 21 to a support rod 32 joined to lead-in conductor 5.

The geometry of the seal structure permitted by my invention at the exhaust end provides improved heat transport to the amalgam reservoir. The distal end of the electrode shank is at the maximum electrode temperature and since the shank now extends all the way through the butterfly crimp 28, it assures good heat transfer out to that point. The improved temperature gradient assures that the liquid amalgam pool is located within the reservoir section, that is between the crimp 28 and pinch 30 during lamp operation, and eliminates any need for grit blasting.

As a result of the restricted channels 29 at the butterfly crimp, my invention achieves a universal operating lamp. The heat balance is such that the tipped end 30 is the cold spot of the lamp in which excess amalgam collects. If the lamp is operated with the exhaust tube lowermost, both the heat balance and gravity operate to keep excess amalgam at the tip. If the lamp is inverted and operated with the exhaust tube uppermost, the heat balance will cause excess amalgam to condense at the tip and surface tension or capillary attraction is normally sufficient to hold the excess there in a wedge-shaped volume. However should it happen under the stress of vibration or mechanical shock that a droplet of amalgam break loose from the wedge-shaped volume, in such case the falling droplet is caught in one of the restricted channels 29. The heat balance provides a rise in temperature from tip 30 to the location of the pinch which may be from 10° to 20° centigrade. Due to this temperature difference, the droplet is slowly vaporized and recondensed at the tip where it adds itself to the wedge-shaped volume. However the temperature difference between the crimp and the tip is not high enough to cause a vapor pressure rise which would be noticeable in the operation of the lamp. The invention thus achieves the benefit of universal burning together with an external reservoir construction using a minimum quantity of expensive niobium.

I have described and illustrated my invention in connection with an end seal comprising a ceramic plug through which the niobium exhaust tube extends. However it may also be used with end seals comprising niobium end caps as in the prior art, for instance as illustrated in FIG. 5 of U.S. Pat. No. 3,708,710 — Smyser and Speros, issued Jan. 2, 1973 which is incorporated herein by reference. In such case the metal exhaust tube of the invention is welded where it enters the niobium end cap and may be cut off at that point so that it does not extend internally into the envelope. However the other features which have been described are not changed. In particular the tungsten electrode is mounted on a long shank projecting into the niobium tube and is locked in place by crimping the tube about it outside the envelope. Preferably the butterfly crimp which has been described is used in order to leave restricted channels which allow passage of the alkali in vapor form but prevent its movement as a liquid. The reduction in the quantity of niobium used with this variant is of course less than with that illustrated in FIGS. 2 and 3.

What I claim as new and desire to secure by Letters Patent of the United States is:

1. An electric discharge lamp comprising:

a tubular light-transmitting ceramic envelope having closures and thermionic electrodes in its ends and containing an ionizable filling, a closure and electrode assembly at one end of said envelope comprising a tubular metal inlead conductor hermetically sealed to said envelope and extending externally thereof, and an electrode located within the envelope mounted on a metal shank which projects into the tubular inlead and which is locked in place by crimping the inlead about it at a place outside the envelope, said inlead being closed at its outer end and said shank ending short of said closed end and receiving its entire support through said crimping.

2. A lamp as in claim 1 wherein the filling includes alkali metal in excess of the quantity vaporized during operation and the crimping is at an intermediate point and leaves restricted channels which allow passage of alkali metal in vapor form but prevent its movement as a liquid.

3. A lamp as in claim 1 wherein said metal shank is of tungsten.

4. A high pressure vapor discharge lamp comprising:

a tubular light-transmitting ceramic envelope having closures and thermionic electrodes in its ends and containing an ionizable filling including alkali metal in excess of the quantity vaporized during operation, a closure and electrode assembly at one end of said envelope comprising a closure member sealed to said envelope and having a hole therethrough, a tubular inlead conductor sealed to said member and extending through said hole externally of said envelope, and an electrode located within the envelope mounted on a metal shank which projects into the tubular inlead and which is locked in place by crimping the inlead about it at a place outside the envelope, the crimping leaving restricted channels which allow passage of the alkali in vapor form but prevent its movement as a liquid, said inlead being closed at its outer end and said shank ending short of said closed end and receiving its entire support through said crimping.

5. A lamp as in claim 4 wherein the closure member is a ceramic plug and the tubular inlead is of metal which substantially matches the plug in coefficient of expansion.

6. A lamp as in claim 4 wherein the closure member is a metal end cap and the tubular inlead extends through the end cap and is welded to it.

7. A lamp as in claim 4 wherein the electrode shank is of tungsten.

8. A lamp as in claim 4 wherein the filling comprises sodium mercury amalgam, the envelope is of alumina ceramic, the closure member is an alumina ceramic plug sealed to the envelope by sealing frit, and the tubular inlead is of niobium sealed to the plug by sealing frit.

* * * * *